US005248071A

United States Patent [19]

Ray

[11] Patent Number: 5,248,071

[45] Date of Patent: Sep. 28, 1993

[54] RE-SEALABLE NOZZLE AND CAP ASSEMBLY

[76] Inventor: Cecil D. Ray, P.O. Box 681, Fall River Mills, Calif. 96028

[21] Appl. No.: 721,165

[22] Filed: Jun. 26, 1991

[51] Int. Cl.[5] ..... B65D 41/04

[52] U.S. Cl. ..... 222/568; 222/566; 222/575; 239/390; 239/600

[58] Field of Search ..... 222/529, 566, 568, 575, 222/567; 239/390, 391, 397, 600

[56] References Cited

U.S. PATENT DOCUMENTS

| | | | |
|---|---|---|---|
| 4,258,884 | 3/1981 | Rogers | 239/390 |
| 4,583,668 | 4/1986 | Maynard, Jr. | 222/529 |
| 4,785,951 | 11/1988 | Bennett | 215/32 |
| 4,863,014 | 9/1989 | Summons et al. | 206/45.31 |
| 4,878,599 | 11/1989 | Greenway | 222/1 |
| 4,893,734 | 1/1990 | Chylstun | 222/153 |
| 5,020,702 | 6/1991 | James | 222/529 |
| 5,104,013 | 4/1992 | Hawley | 222/566 |

FOREIGN PATENT DOCUMENTS

| | | | |
|---|---|---|---|
| 3015892 | 10/1981 | Fed. Rep. of Germany | 222/566 |

*Primary Examiner*—Andres Kashnikow
*Assistant Examiner*—Lesley D. Morris
*Attorney, Agent, or Firm*—Laurence Coit

[57] ABSTRACT

The invention is a re-sealable nozzle and cap assembly for dispensing caulking material, sealant, adhesive or the like comprising a hollow nozzle having a generally conical shape. The nozzle includes means at its wider end for connecting the nozzle to a tube. External threaded sections of varying diameter are located along the length of the nozzle. The size of the aperture for dispensing the caulking material or the like can be selected by the user by cutting the nozzle across its conical axis at a point which results in the proper aperture diameter. The assembly also includes a hollow, cylindrical cap sealed at one end and having internal threaded sections of varying diameter along the length of said cap for engaging the exterior threads on said nozzle and thus forming an air-tight seal when said cap is screwed on said nozzle.

12 Claims, 6 Drawing Sheets

RE-SEALABLE NOZZLE AND CAP ASSEMBLY

BACKGROUND OF THE INVENTION

1. Field of the Invention

This invention relates to nozzles and caps used on dispensing tubes for caulking material, sealant, adhesives and the like.

2. Description of Related Art

Caulking and sealant material is commonly sold in compressible tubes with dispensing nozzles for accurate placement of the material. The tubes are available in two general forms. The first comprises a hand squeezable tube having a threaded outlet on one end and the other end is sealed by sealing the two halves of the cylindrical wall together to form a flat, leak-proof connection. A conical, hollow, removable nozzle is screwed on the threaded outlet. The nozzle contains, at its distal end, an aperture for dispensing the material. This type of tube usually contains a relatively small quantity of material for small jobs or repairs. For larger jobs, the tube generally has a nozzle mounted on a circular plate which seals one end of the tube. The other end of the tube contains a movable, circular seal placed within the cylindrical wall of the tube. The tube is placed in a caulking gun which has a piston which engages the circular seal. Means are provided on the caulking gun for gradually forcing the piston against the seal. As the seal is forced into the tube, the material contained therein is expelled through the nozzle aperture.

In either case, the nozzle is hollow and generally conical in shape with the widest diameter located near the tube and the smallest diameter at the distal end of the nozzle. The nozzle can be cut off anywhere between the tube end and the distal end thus fixing the diameter of the nozzle exit aperture and therefore the diameter of the caulking material bead dispensed by the tube-nozzle combination.

These arrangements work fine when all of the material in the tube is dispensed in the course of the job. However, if only a portion of the material is dispensed on a particular job, the sealant or caulking material usually hardens in the nozzle thus plugging the aperture and wasting a significant quantity of the material. Prior to using the tube again, effort and time must be expended to clear the nozzle.

In the case of the removable nozzle, the nozzle must be unscrewed from the tube and an instrument inserted in the aperture of the nozzle to force the hardened plug out the larger diameter end of the nozzle. If the hardened material within the nozzle is an adhesive, this task can be very difficult often ending in the destruction of the nozzle. In the case of the fixed nozzle, the problem is more difficult. Since the nozzle cannot be removed, the dried plug must be extracted from the nozzle aperture. Since the nozzle is conical with its smallest diameter at the aperture, a sharp instrument must be inserted in the aperture to cut up the solidified plug so the pieces can be removed from the aperture.

One approach to resolving this problem is exemplified by U.S. Pat. No. 4,878,599 issued to John M. Greenway on Nov. 7, 1989. This patent discloses a generally conical shaped nozzle made up from a plurality of cylinders of decreasing diameters. This design facilitates the removal of the dried plug because, provided the dried plug is located in only one of the cylindrical sections, its diameter is constant and it can easily be pried or forced out of the nozzle aperture. However, if the dried plug extends for a sufficient length to include two cylindrical sections of the nozzle, the step change in plug diameter makes it even more difficult to remove than the plug formed in an evenly taper nozzle.

A more practical and effective solution to this problem is to provide a re-sealable nozzle cap assembly which prevents drying of the caulking or sealing material while still providing an adjustable nozzle aperture outlet diameter for controlling the size of the dispensed bead.

OBJECTS AND SUMMARY OF INVENTION

One object of the present invention is to provide a re-sealable nozzle cap assembly which minimizes the amount of time and effort involved in reusing a partially used tube of caulking, sealant, adhesive or the like.

Another objective of the present invention is to minimize the amount of wasted caulking, sealant or adhesive material associated with reusing a dispensing nozzle.

These and other objects are achieved in a re-sealable nozzle and cap assembly for dispensing caulking material, sealant, adhesive or the like comprising a hollow nozzle having a generally conical shape. The nozzle includes means at its wider end for connecting the nozzle to a tube. External threaded sections of varying diameter are located along the length of the nozzle. The size of the aperture for dispensing the caulking material or the like can be selected by the user by cutting the nozzle across its conical axis at a point which results in the proper aperture diameter. The assembly also includes a hollow, cylindrical cap sealed at one end and having internal threaded sections of varying diameter along the length of said cap for engaging the exterior threads on said nozzle and thus forming an air-tight seal when said cap is screwed on said nozzle.

DETAILED DESCRIPTION OF PREFERRED EMBODIMENTS

Figure 1:
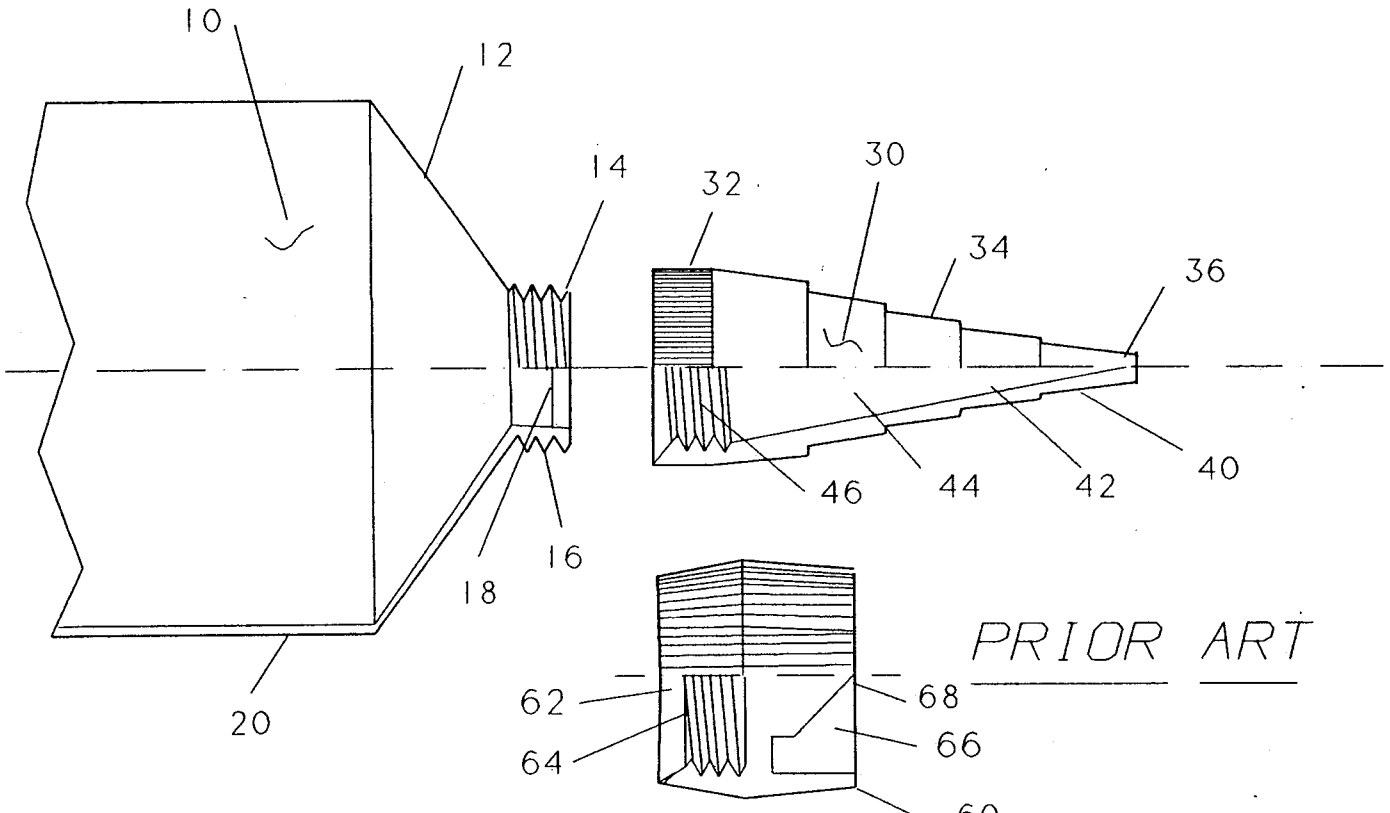
FIG. 1 is a composite section and outline elevation view of the prior art tapered, dispensing nozzle with separate tube sealing cap.

Referring to FIG. 1, a common embodiment of the prior art dispensing nozzle is shown. Tube 10 stores the caulking or other material in an air-tight manner until the material is to be applied to a work surface. Tube 10 is formed from a thin sheet of maleable material 20 which is rolled into a cylindrical shape and then sealed by adhesive or solder. One end of tube 10 is formed into truncated conical section 12 which terminates in a small diameter, hollow, cylindrical section 14 which acts as an outlet for the material contained in the tube 10. The other end of tube 10 (not shown) is sealed by flattening the tube 10 until the opposite walls come together in a flat plane and the joint thus formed is sealed by adhesive or solder.

Cylindrical outlet 14 contains external threads 16 for a threaded connection to either nozzle 30 or cap 60. Cylindrical section 14 also contains a sealing diaphragm 18 recessed within the hollow portion of cylindrical outlet 14. Diaphragm 18 is flat and circular with its circumference sealed to the interior surface of cylindrical outlet 14 so as to form an air-tight seal for tube 10.

Hollow nozzle 30 is generally conical in shape having a large diameter end 32 for attaching to tube 10 and a small diameter end 36 for applying the caulking or other material to a work surface (not shown). The exterior surface of the nozzle tapers from large diameter end 32 to small diameter end 36. This taper 34 can be either uniform or stepped as shown in FIG. 1. The interior, conical surface 42 of nozzle 30 provides a passage way 44 for caulking or other material to flow from the tube 10 to the work surface (not shown). The interior conical surface 42 can be evenly tapered as shown or stepped in the fashion of the Greenway patent. Large diameter end 32 contains interior threads 46 for attaching the nozzle 30 to tube 10 by engaging with threads 16 on cylindrical outlet 14. The small diameter end 36 of nozzle 30 is sealed by the apex 40 formed by interior conical surface 42.

The cap 60 is cylindrical in shape having a recess 62 in one end containing interior threads 64 for engaging threads 16 on tube 10. The opposite end of cap 60 contains an annular recess 66. The center of annular recess 66 contains cone 68.

The tube 10 is sold in suitable packaging (not shown) with the cap 60 threaded on the outlet 14. Nozzle 30 is provided in the package loose. The user removes cap 60 from outlet 14, inverts the cap and pushes it over outlet 14 so that cone 68 in cap 60 engages and ruptures sealing diaphragm 18 contained in outlet 14. The user then removes cap 60 and attaches the nozzle 30 to outlet 14 by engaging threads 46 with threads 16. The user then determines the desired caulking material bead size and using a knife cuts the nozzle 30 perpendicular to its axis at a point along the taper 34 to provide the desired aperture diameter formed by nozzle interior surface 42. By squeezing tube 10, the user causes caulking material to flow from tube 10 through outlet 14 and passage 44 onto the work surface at the desired bead diameter. After use, the nozzle 30 is removed from outlet 14 and cap 60 is screwed on outlet 14 by engaging threads 46 with threads 16 thus forming an air-tight seal to prevent caulking material in tube 10 from drying out and hardening. Nozzle 30 retains caulking material in passage 44 and unless it is cleaned immediately with a suitable solvent, the caulking material forms a plug in passage 44 which must be removed, with great difficulty, prior to reusing the nozzle 30.

Figure 2:
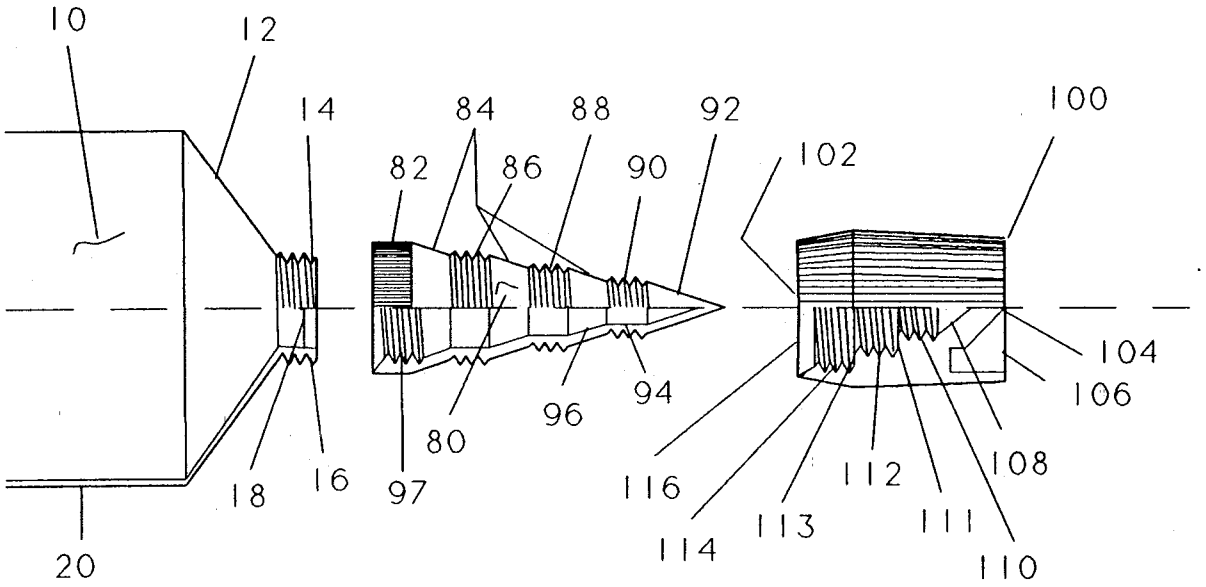
FIG. 2 is a composite section and outline elevation view of the re-sealable, nozzle and cap assembly of the present invention.

Turning now to FIG. 2, the re-sealable nozzle cap assembly of the present invention is illustrated. Hollow nozzle 80 has a large diameter end 82 and a small diameter end 92 thus forming a generally conical shape. The exterior surface of nozzle 80 contains three spaced apart sets of exterior threads 86,88 and 90 each having progressively smaller diameters to conform with the taper of the nozzle. Although three sets of threads 86, 88 and 90 are depicted, it is readily understood that any number of sets of threads can be used in the present invention. Tapered transition sections 84 separate, along the axis of nozzle 80, each of threads 86, 88 and 90. In addition, tapered transition sections 84 separate thread 86 from the large diameter end 82 of the nozzle 80 and separate thread 90 from the small diameter end 92 of nozzle 80. The interior surface of nozzle 80 along its axis consists of alternating constant diameter sections 94 and tapered sections 96. The internal constant diameter sections 94 are located in axial coincidence with the exterior threads 86,88 and 90. The internal tapered sections 96 are placed in axial coincidence with the exterior tapered transition sections 84. In this manner, the user can, by cutting the nozzle 80 off perpendicular to the axis of the nozzle in one of the tapered transition sections 84, select any diameter discharge aperture without damaging the exterior thread sets 86, 88 or 90. In an alternate manner, the user can cut off the nozzle 80 at an oblique angle thus forming an elliptical aperture (not shown) which is useful in producing a fillet type bead of caulking material for filling a corner formed by perpendicular working surfaces (not shown).

Cap 100 is generally cylindrical in exterior shape. One end of the cap 100 contains recess 102 of stepped internal diameter. Recess 102 contains three sets of internal threads 114, 112 and 110 having decreasing diameters which match exterior sets of threads 86, 88 and 90 on nozzle 80, respectively. As in the prior art, internal thread 114 is sized to engage external thread 14 on tube 10 so that cap 100 can seal tube 10 before and after use of nozzle 80. Recess 102 terminates with interior surface 108 forming an acute angle with the axis of nozzle 80 thus making a sealed cone at the deepest portion of recess 102. The internal sets of threads 114, 112 and 110 within recess 102 are located adjacent to one another along the axis of cap 100 thus forming surface 111 between thread set 110 and 112 and surface 113 between thread sets 112 and 114. Surfaces 111 and 113 thus form interior annular rings of different diameters located in a plane perpendicular and concentric to the axis of cap 100. The end of cap 100 which is opposite the end containing recess 102 is sealed and contains a recess 106. Recess 106 is annular with cone 104 located in its center. The apex of cone 104 is in general axial alignment with the end of the cap 100.

The user prepares the caulking tube 10 for use by inverting the cap 100 and forcing apex of cone 104 into diaphragm seal 18 in the usual manner. After opening outlet 14, the user would screw nozzle 80 on outlet 14 by engaging threads 97 with threads 16. The user would then cut off the end of nozzle 80 in any of the tapered transition sections 84 to obtain the desired discharge aperture. The user then applies the caulking material to the work surface by squeezing tube 10 and expelling caulking material from the discharge aperture. By moving the tube 10 and nozzle 80 over the work surface, a smooth, continuous bead of caulking material having a constant diameter can be applied to the work surface. Upon completion of applying the caulking material, the user can re-seal the open end of nozzle 80 by screwing cap 100 on the remaining exterior thread set of nozzle 80.

Figure 3:
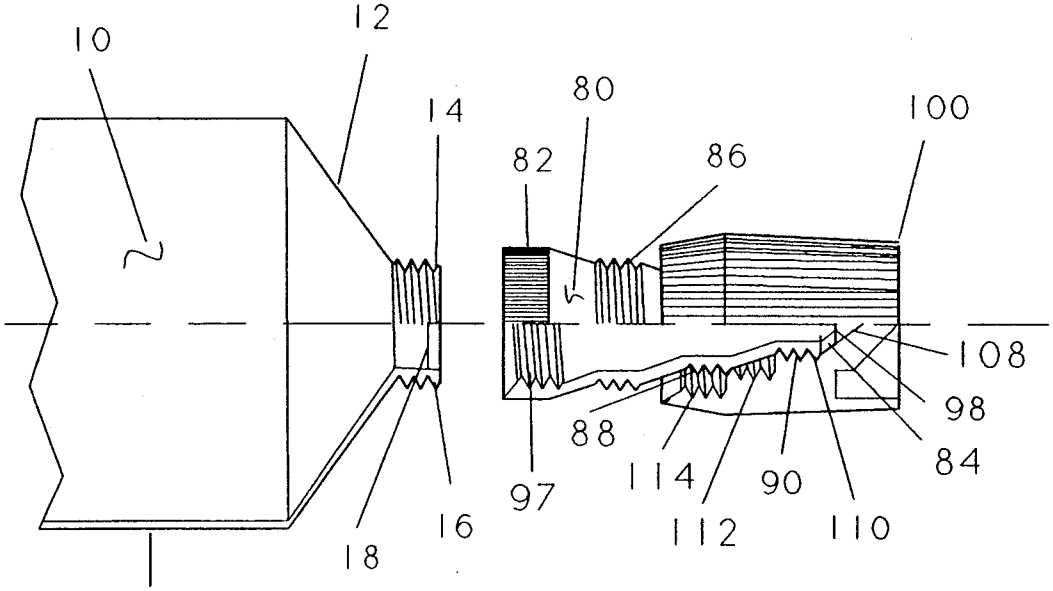
FIG. 3 is a composite section and outline elevation view of the re-sealable, nozzle and cap assembly of the present invention with the nozzle cut off to effect the smallest dispensing aperture and showing the cap mounted on the nozzle in the sealed position.
Figure 6:
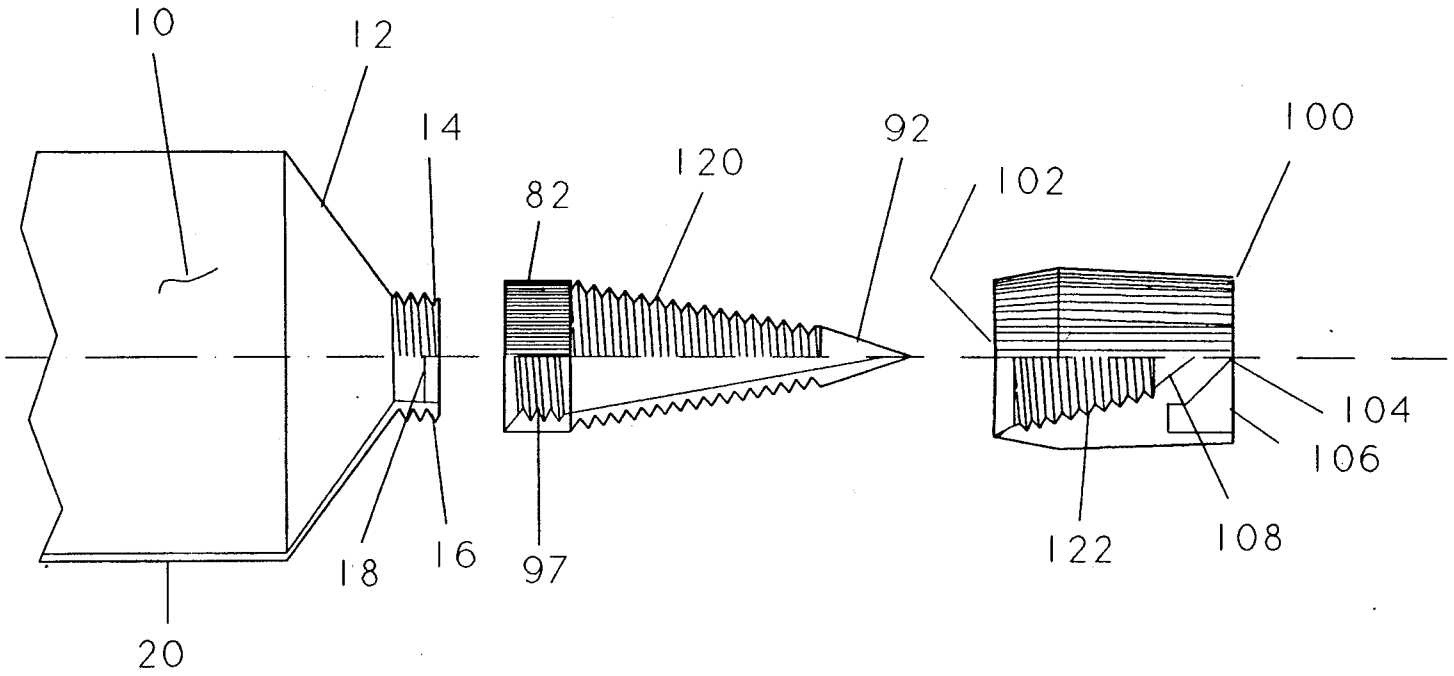
FIG. 6 is a composite section and outline elevation view of the re-sealable nozzle and cap assembly of the present invention using a continuous spiral thread on the nozzle and cap.

Although the nozzle 80 described above contains separated threaded sections 86, 88 and 90, it is readily understood that the objects of the invention can be achieved by using stepped threaded sections adjacent to one another or a continuous spiral thread 120 from the apex of the nozzle 80 to the large diameter end 82 of the nozzle as shown in FIG. 6. In the case of a continuous spiral thread, cap 100 would require a continuous internal spiral thread 122 instead of thread sets 110, 112 and 114, again as shown in FIG. 6. Turning now to FIG. 3, the nozzle cap assembly is shown re-sealed after initial use. In this illustration, nozzle 80 has been cut off in tapered transition section 84 resulting in discharge aperture 98. This small diameter discharge aperture 98 is used when a very fine bead of caulking material is desired. When cap 100 is screwed on nozzle 80 to re-seal the tube 10, the smallest diameter thread set 110 in cap 100 engages the smallest diameter nozzle thread set 90 to effect an air-tight seal. In addition, when the cap 100 is screwed on to nozzle 80 all the way, the outside surfaces of the remainder of tapered transition section 84 contact the conical recess formed by surface 108 in cap 100 to effect a second sealing surface thus assuring an air-tight seal. Since interior thread sets 110, 112 and 114 are axially adjacent in cap 100 while exterior thread sets 86, 88 and 90 on nozzle 80 are axially spaced apart by tapered transition sections 84, only one pair of matching internal and external threads will engage at one time no matter which tapered transition section 84 is cut to produce a discharge aperture 98.

Figure 4:
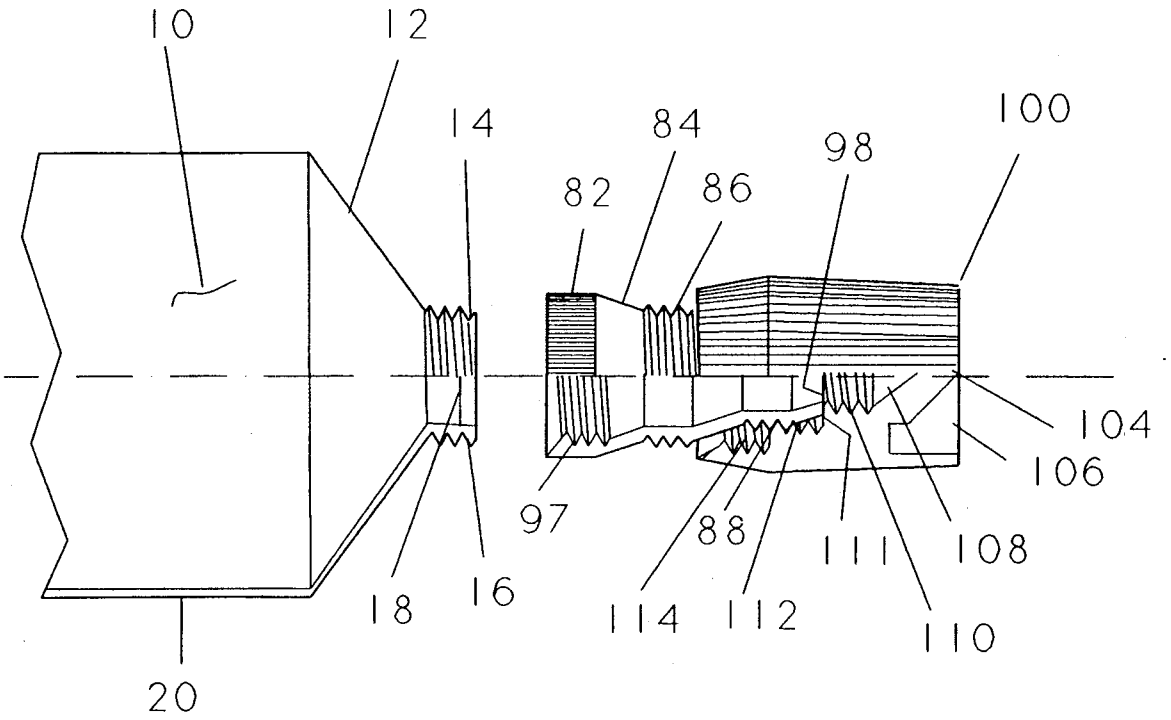
FIG. 4 is a composite section and outline elevation view of the re-sealable, nozzle and cap assembly of the present invention with the nozzle cut off to effect an intermediate size dispensing aperture and showing the cap mounted on the nozzle in the sealed position.

Referring now to FIG. 4, the nozzle cap combination is shown re-sealed after cutting off the nozzle to effect an intermediate size discharge aperture 98. In this mode, cap 100 is screwed on nozzle 80 by engaging interior cap thread set 112 with exterior nozzle thread set 88. By threading the cap 100 further on to nozzle 80, the cut off end of nozzle 80 comes into abutting contact with annular ring surface 111 contained in cap 100 thus effecting a second seal to assure an air tight connection.

Figure 5:
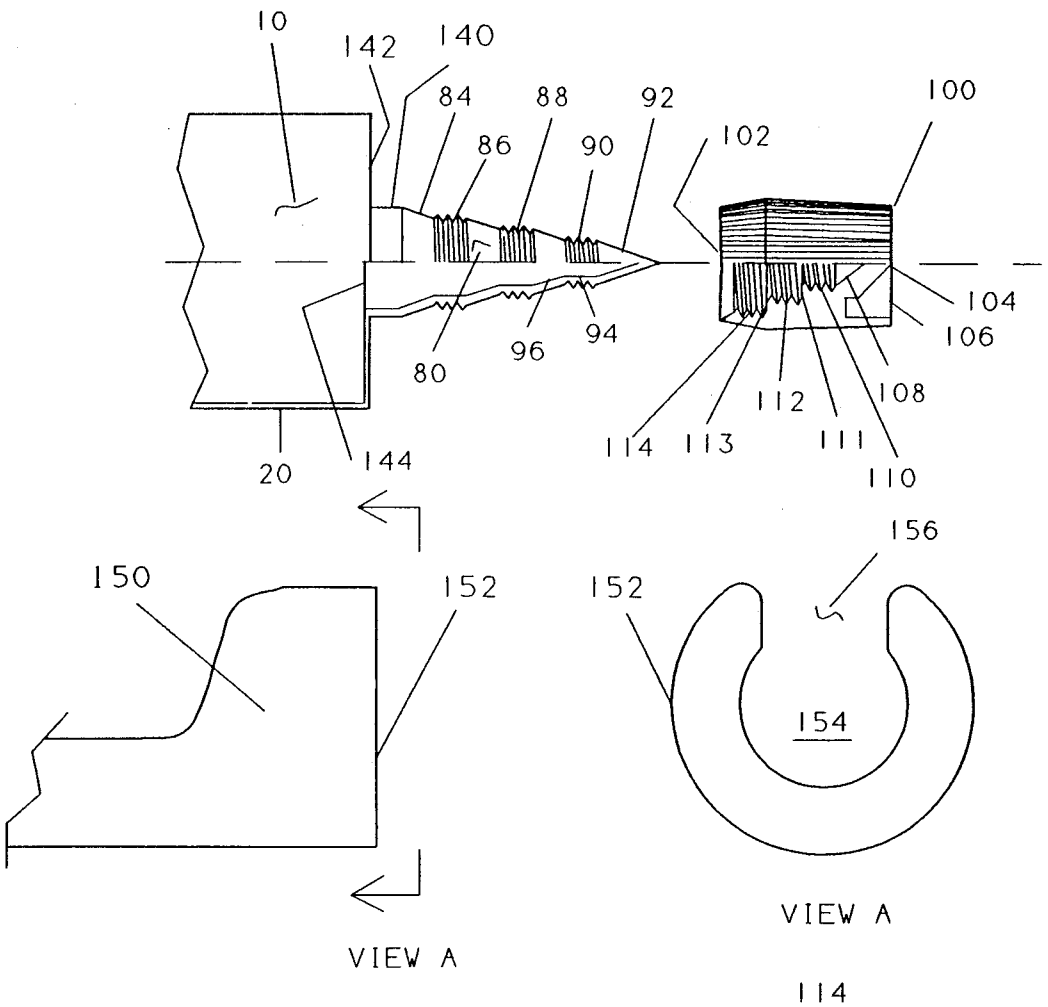
FIG. 5 is a composite section and outline elevation view of an alternate embodiment of the re-sealable, nozzle and cap assembly of the present invention which has been designed for use with a caulking gun.

Turning now to FIG. 5, an alternate embodiment of nozzle 80 is shown. In this embodiment, the nozzle 80 is adapted for use with a caulking gun 150. For clarity, only the forward end of the caulking gun is depicted to show the positioning of tube 10 with nozzle 80 in the caulking gun 150. In this embodiment, the widest end of nozzle 80 is fitted with a hollow cylindrical section 140 which, in turn is attached to a circular plate 142. Plate 142 contains a concentric circular aperture 144 to provide a communicating passage between tube 10 and nozzle 80 for the flow of caulking material therethrough. Caulking gun 150 is generally tubular in shape having a diameter slightly larger than tube 10 so that tube 10 can be positioned within the caulking gun 10 in a manner known to those familiar with the art. Caulking gun 150 has at its forward end a circular end piece 152 containing an aperture 154 and access slot 156. The tube 10 and nozzle 80 combination is placed in caulking gun 150 so that nozzle 80 protrudes through aperture 154 and circular plate 142 abuts against end piece 152. In this manner, application of a piston (not shown) against the end of tube 10, forces circular plate 142 against end 152. By applying force through the piston to the opposite end of tube 10, the tube 10 is compressed forcing caulking material out of tube 10, through aperture 144 and into nozzle 80. From nozzle 80, the caulking material is expelled through aperture 98 onto the work surface.

The re-sealable nozzle and cap assembly thus described and many of its attendant advantages will be understood from the foregoing description and it will be apparent that various changes may be made in the form, construction and arrangement of the parts thereof without departing from the spirit and scope of the invention or sacrificing all of its material advantages, the form hereinabove described being merely a preferred or exemplary embodiment thereof.

I claim:

1. In a tube and nozzle combination designed for applying caulking, adhesive or sealing compounds to a work surface, a re-sealable nozzle and cap assembly comprising:

a. a conical, hollow, one-piece nozzle having an apex end and a wide end such that said nozzle can be cut creating an aperture of selectable size for the discharge of said compounds, said aperture having a nominal diameter dependent upon the axial location of said cut;

b. threads on the exterior surface of said nozzle having a nominal diameter increasing from said apex end of said nozzle to said wide end of said nozzle;

c. a generally cylindrical cap having a first sealed end and a second recessed end, said recessed end comprising an interior, conical section containing internal, continuous threads having a nominal diameter which decreases from said recessed end of said cap to said sealed end of said cap for engaging said threads on the exterior surface of said nozzle and effecting an air-tight seal between said nozzle and said cap;

whereby said nozzle can be re-sealed by engaging the threads of said cap on the threads of said nozzle after said nozzle has been cut anywhere along its axial length.

2. A re-sealable nozzle cap assembly as recited in claim 1 wherein said exterior thread on said nozzle further comprises a first set of threads located at said wide end of said nozzle and a plurality of subsequent sets of exterior threads positioned along the axis of said nozzle from said wide end to said apex end, each of said subsequent sets having a nominal diameter slightly less than the nominal diameter of the preceding set for matching the general conical shape of said nozzle.

3. A re-sealable nozzle cap assembly as recited in claim 2 wherein said sets of threads are spaced apart along the axis of said nozzle by a plurality of hollow, truncated conical sections of said nozzle.

4. A re-sealable nozzle cap assembly as recited in claim 3 wherein the interior surfaces of said hollow nozzle opposite said exterior sets of threads are parallel to the axis of said nozzle so that cutting the nozzle perpendicular to the axis of said nozzle in one of said hollow, truncated conical sections results in a circular, discharge aperture of any, selectable diameter between the largest internal diameter of said wide end of said nozzle and the smallest internal diameter of said apex end of said nozzle.

5. A re-sealable nozzle cap assembly as recited in claim 3 wherein the interior surfaces of said hollow nozzle opposite said exterior sets of threads are parallel to the axis of said nozzle so that cutting the nozzle at any oblique angle to the axis of said nozzle in one of said hollow, truncated conical sections results in an elliptical, discharge aperture having any, selectable minor axis diameter between the largest internal diameter of said wide end of said nozzle and the smallest internal diameter of said apex end of said nozzle and any, selectable major axis diameter dependent upon the oblique angle used for the cut.

6. A re-sealable nozzle cap assembly as recited in claim 2 wherein said interior, conical section of said cap further comprises a plurality of axially adjacent sets of internal threads each of said sets sized to engage one of said exterior thread sets on said nozzle with the internal thread set of smallest diameter located at the apex end of said internal, conical section and each adjacent internal thread set having a slightly greater internal diameter than the preceding internal thread set with the largest diameter internal thread set located at the recessed end of said internal, conical section.

7. A re-sealable nozzle cap assembly as recited in claim 6 wherein the transition between each internal thread set forms an annular ring concentric and perpendicular to the axis of said cap for sealingly abutting the cut end of said nozzle thereby forming a second air-tight seal between said cap and said nozzle when said cap is screwed on said nozzle.

8. A re-sealable nozzle cap assembly as recited in claim 1 wherein the exterior of said first sealed end of said cap contains an annular recess having a cone centered therein with the apex of said cone extending away from said cap, whereby said cone can be used for piercing a sealing diaphragm on the outlet of said tube.

9. A re-sealable nozzle cap assembly as recited in claim 1 wherein said tube has a cylindrical outlet section containing exterior threads and said wide end of said nozzle contains internal threads for engaging said exterior threads on said outlet section whereby said nozzle can be screwed on said tube.

10. A re-sealable nozzle cap assembly as recited in claim 1 wherein said wide end of said nozzle is attached to and said apex end of said nozzle extends from a circular plate which is connected to the end of said tube.

11. A re-sealable nozzle cap assembly as recited in claim 1 wherein said internal thread in the conical section of said cap further comprises a continuous, spiral thread having decreasing nominal diameter from said recessed end of said cap to said sealed end of said cap.

12. In a tube and nozzle combination designed for applying caulking, adhesive or sealing compounds to a work surface, a re-sealable nozzle and cap assembly comprising:

a. a conical, hollow nozzle having an apex end and a wide end;

b. threads on the exterior surface of said nozzle, said threads comprising a first set of threads located at said wide end of said nozzle and a plurality of subsequent sets of exterior threads positioned along the axis of said nozzle from said wide end to said apex end, each of said subsequent sets having a nominal diameter slightly less than the nominal diameter of the preceding set for matching the general conical shape of said nozzle, said sets of threads spaced apart along the axis of said nozzle by a plurality of hollow, truncated conical sections of said nozzle and wherein the interior surfaces of said hollow nozzle opposite said exterior sets of threads are parallel to the axis of said nozzle so that cutting the nozzle perpendicular or at an oblique angle to the axis of said nozzle in one of said hollow, truncated conical sections results in a circular or elliptical discharge aperture of any, selectable diameter between the largest internal diameter of said wide end of said nozzle and the smallest internal diameter of said apex end of said nozzle;

c. a generally cylindrical cap having a first sealed end and a second recessed end, said recessed end comprising an interior, conical section containing threads comprising a plurality of axially adjacent sets of internal threads each of said sets sized to engage one of said exterior thread sets on said nozzle with the internal thread set of smallest diameter located at the apex end of said internal, conical section and each adjacent internal thread set having a slightly greater internal diameter than the preceding internal thread set with the largest diameter internal thread set located at the recessed end of said internal, conical section for engaging said threads on the exterior surface of said nozzle and effecting an air-tight seal between said nozzle and said cap when said cap is screwed on said nozzle;

whereby said nozzle can be cut creating an aperture of selectable size for the discharge of said compounds, said aperture having a nominal diameter dependent upon the axial location of said cut, and said nozzle can be re-sealed by engaging the threads of said cap on the remaining threads of said nozzle.

* * * * *